US007063048B2

(12) United States Patent
Ieda

(10) Patent No.: US 7,063,048 B2
(45) Date of Patent: Jun. 20, 2006

(54) ARRANGEMENT FOR INTEGRATION OF A DOUBLE THERMOSTAT IN AN ENGINE

(75) Inventor: João José Cardinali Ieda, Piracicaba (BR)

(73) Assignee: Wahler Metalurgica Ltda., Piracicaba (BR)

( * ) Notice: Subject to any disclaimer, the term of this patent is extended or adjusted under 35 U.S.C. 154(b) by 0 days.

(21) Appl. No.: 11/018,905

(22) Filed: Dec. 21, 2004

(65) Prior Publication Data

US 2006/0081200 A1 Apr. 20, 2006

Related U.S. Application Data

(60) Provisional application No. 60/618,723, filed on Oct. 14, 2004.

(51) Int. Cl.
*F01P 7/14* (2006.01)

(52) U.S. Cl. ..... 123/41.1; 236/34.5; 137/454.2

(58) Field of Classification Search ..... 123/41.1, 123/41.08; 236/34.5, 101 A; 137/315.04, 137/454.2; 403/348, 349
See application file for complete search history.

(56) References Cited

U.S. PATENT DOCUMENTS 6,044,808 A * 4/2000 Hollis ..... 123/41.1

* cited by examiner

*Primary Examiner*—Tony M. Argenbright
*Assistant Examiner*—Katrina Harris
(74) *Attorney, Agent, or Firm*—William J. Sapone; Coleman Sudol Sapone, P.C.

(57) ABSTRACT

A cover is used to integrate two thermostat valves in a compact set, wherein the cover has a hollowed body (1) projected from a flange (2) converging to a center part in which a vertical tubular element (5) is fitted to interconnect with a radiator via a hose. In the interior of the hollowed body (1), there are two adjacent galleries (7) shaped with independent end entrances (8 and 9) that are open in the base of the flange (2), and which share a single exit (10) defined by the tubular element (5). The mouthpieces of the two independent entrances are surrounded by grooves (11) that receive sealing rings (12). On two diametrically opposing sides of each independent entrance (8 and 9) of adjacent galleries (7), two orthogonal legs (13) are projected, the legs having facing grooves (14) for receiving the thermostat ends therein, the thermostats being in alignment with the center of each independent entrance (8 and 9), a protuberance (15) provided with a hole (16) is used to centralize the assembly of the two thermostats.

9 Claims, 3 Drawing Sheets

ARRANGEMENT FOR INTEGRATION OF A DOUBLE THERMOSTAT IN AN ENGINE

TECHNICAL FIELD

The present invention refers to a new constructive arrangement for coupling an assembly housing to an engine for integrating a double thermostat to an engine for use in the automobile industry.

BACKGROUND

The invention provides a series of technical, practical, functional and economic advantages, and fulfills its functions in an efficient and satisfactory way. The invention also offers the possibility of an economic industrialization with significant reduction of costs, labor and material, as well as increasing the accuracy of assembly, providing optimum results with good reliability.

A thermostat is a component that is located between an engine and a cooling system normally including a radiator. The function of a thermostat is to control the passage of the cooling liquid to the radiator and to the engine, keeping the engine working temperature within the ideal limits, preventing the engine from working too hot or too cold, in order not to suffer more wear. Thermostat functioning consists in heating an element constituted of an expander mass, which provides the opening of the thermostatic element after the absorption of definitive amount of heat and through thermal expansion, regulating the valve opening and therefore the flow of coolant through automotive engines.

The integrated thermostat is constituted of a joint element with an arch and a spring, assembled on a cover or on a housing that can be made of polymeric, metallic or nonmetallic material, which can be obtained by molding, injection or machining processes. The thermostat can also provide more functions to the system in accordance with the configurations, by using:

a double valve containing two thermostat elements, which can be calibrated with the same or with different initial opening settings, allowing a greater and more controlled flow rate of cooling liquid from/to the radiator.

a cover made of aluminum or plastic, obtained by a machining or casting process, and especially in this case, by a process of casting under pressure, which provides a part with less material (less weight) and requiring less time for machining.

If necessary to the particular cooling system, the valve can comprise the following as well:

components, such as nipples, tubes, temperature sensor, hoses (heating system and radiator compartments), sealing and attaching rings/joints for attaching the thermostat set to the engine block;

Tube to connect to the heating system (passenger compartment);

Tube to fix to the radiator hose;

De-airing system;

Sealing system, and;

Temperature sensor.

Configurations:

The thermostat has an outlet configuration. In this case, the thermostat receives liquid from the engine and, through the working element, regulates the amount of flow that will be directed to the radiator for cooling, as well as the amount of fluid that will continue circulating internally of the engine, without cooling.

For this thermostat, it is possible to have an inlet configuration. In this case, the thermostat receives liquid from the engine and from the radiator, consequently, through the working element, the amount of cooled flow that will be directed from the radiator to the engine (mixture of hot and cold liquid) is regulated, as well as the amount of fluid that will continue circulating internally of the engine, without cooling.

Functional Characteristics:

Initial Opening: The initial opening setting is a characteristic that, at the initial temperature, the thermostatic valve allows the beginning of the passage of the cooling liquid from/to the radiator. In this invention, the initial opening can be varied for several different engine applications. The initial opening can be calibrated with the same or with a different initial opening settings, since two working elements are present.

Course: The course or degree of opening is a characteristic that provides an opening amount relative to an increment in temperature, wherein the flow rate range from the thermostatic valve will vary for the passage of the cooling liquid to the radiator. In this invention, the course can be varied for some applications, and can be calibrated with the same or with a different course, since two working elements are present.

Leakage: leakage is a characteristic that provides the maximum amount of bypass flow of cooling liquid allowed to the radiator when the system is pressurized and the thermostatic valve is closed. In this invention, the leakage can be varied for some applications, and can be calibrated with the same or with a different bypass amounts, since two working elements are present.

Functions that are or can be Aggregated:

In accordance with the present invention, the integrated thermostat has its constructive arrangement of the cover or housing modified in order to provide other functions, by incorporating other components, such as:

a tube for heating system;

a tube to fix the radiator hose;

a temperature sensor;

a de-airing system;

a nipple, and;

a sealing system.

Configurations:

The tube for heating system allows the passage of the heated cooling liquid to the heating system in the interior of the vehicle. The following versions can be obtained:

Tube injected together with the cover: this tube can be obtained with or without a complementary machining process, and can be differently configured with different fixation angles, internal/external diameter and lengths.

Tube manufactured separately, made of plastic, metallic or non-metallic material, and assembled on the cover by threading or assembled by interference or clearance, using glues as the fixation and sealing element.

The tube to attach the radiator hose allows the passage of the cooling liquid to the radiator. This tube, as well as the tube for the heating system, can be made of aluminum, plastic, metallic or non-metallic material, and it can be obtained by special and/or conventional manufacture processes, and can be differently configured with different fixation angles, internal/external diameter and lengths.

The temperature sensor is a component that indicates the temperature variation in the valve region. This temperature sensor has the function of sending a data signal to the electric injection central processing and management unit of the engine, in accordance with the temperature of the cooling liquid, and/or the sensor indicates the temperature of the coolant on the vehicle instrument panel.

The temperature sensor can be differently configured with different fixation angles, and lengths. It can be assembled by threading, stapling or by interference on the cover. Its assembly can be sealed by back edge or by ring sealing systems.

The de-airing system or air bleed devices (air bleeder) can be configured through ball systems, or a jingle pin or notches located on the cover of the working element or even on the thermostat housing, functioning as a valve which allows air to escape from the region of the thermostat element that is at the highest point of the engine (generally, the expansion reservoir) during the filling with cooling liquid. A system without a de-airing valve or jingle pin can also be de-aired. In this case, the air is eliminated from the element region by means of nipples and hoses located strategically on the thermostat.

The nipple also has the function of de-airing the cooling system, and it can be made of plastic, brass, metal and non-metal material, as well as it can be differently configured with different fixation angles, internal/external diameter and lengths. The nipple can be assembled on the housing by threading, interference fit or with a clearance, using glues as the attachment and sealing element.

The interface of this nipple with the hose of the cooling liquid reservoir can be made by quick coupling or straight profiles and/or by interference with neck/hose, which guarantees the fixation of conduction hoses by means of tighteners and/or clamps.

The sealing system is responsible for guaranteeing that the cooling liquid will not leak out of the thermostat, mainly in the assembly region between the valve flange and the head and/or engine. This system can be constituted by a joint made of metal or paper, as well as it can comprise a sealing ring that can allow several configurations of profiles (square, rectangular, circular or special profiles). The sealing ring can be confined within a lodging generally situated in the housing, the sealing ring forced to mold into and fill the irregularities of the parts surfaces, as well as any existing clearance, providing the effect of blocking fluid flow. In some areas around the perimeter of the sealing ring, locks having several formats can be added. Such locks have the function of fixing the sealing ring to the internal confinement channel and defining the assembly indicator.

The integration of two thermostats is possible to a cover or a single housing, substantially differentiated from the conventional and known covers available in the market, which consists in a part with more appropriate robustness and consequent reduction in material, wherein the integration of two thermostats is made by means of two pairs of legs, which are projected in the lower section of the part.

In conventional systems, thermostat valves constitute an independent set that is assembled directly on the engine housing and, after that, it receives the attachment of the respective cover, which is provided with two lodgings, wherein one of them is for each valve thermostat, and with an independent exit for each one of them. The set requires more complex assembly operations, taking not only more time and labor, but also a cost increase, besides requiring special attention to obtain the necessary precision referring to the assembly.

One of the advantages of the integration of double thermostat disclosed in the present invention is that its assembly is much quicker and easier to perform, since it uses a single part (cover or housing) incorporating two thermostat valves.

Another advantage is the ability to, when necessary, substitute one or even the two thermostat valves. Due to the simplicity of removal and replacement, such substitution is made without needing to disassemble the entire set.

In accordance with the present invention, the single housing in which the two thermostats are integrated is provided with two adjacent galleries, having openings that are independent of each other and a single central exit. The constructive arrangement of the present invention utilizes an aluminum injection process or a polymer injection process, which will solve the problem of obtaining those two adjacent galleries with a single and reciprocal central exit and independent openings (mouthpieces), which is impossible to be carried out by using the current methods.

In the injection process, this solution consists in promoting the entrance of a male core by the lower section for conforming the two galleries with independent openings, as well as the entrance of a male core by the upper section for defining the single central exit that is in intercommunication with the two galleries, which results in two galleries with independent entrances and one exit for the cooling liquid to the radiator and to the engine.

The technique determined by the presence of two thermostats in a single part with two chambers and a single central exit allows the accomplishment of two main functions:

Obtaining a minimal passage area to the cooling fluid (minimum passage) in order not to have differentiation of pressure and consequent loss of load in the hydraulic circuit of cooling, and;

Controlling the engine temperature.

The invention does not have restrictions to control the engine temperature due to the fluid exit gallery of the cooling system.

The invention still allows placing two working elements (thermostats) with the same opening calibration temperature and/or different temperature calibrations, wherein the calibration of the working elements with different temperatures is related to the capacity of the springs that can speed or advance the system.

The invention presents versatility as a result of the calibration of the thermostatic valve. An aeration system can also be present in the housing or in the cover. The invention provides a flexible passage, since it has two galleries with a single exit. It can have none, single or double by pass, which provides flexibility and diversity of engine applications. It can have re-circulation by one, two or none.

The two working elements can work with the same opening calibration temperature and/or different temperature calibrations. The calibration of the work elements is related to the spring capacity that can speed or advance the system. It can have different types of flanges and nipples.

Other advantages and characteristics of the present invention will become clear from the following detailed description and the appended claims, taken in conjunction with the accompanying illustrative drawings, which are referred to better elucidate the description.

DETAILED DESCRIPTION OF THE INVENTION

Figure 2:
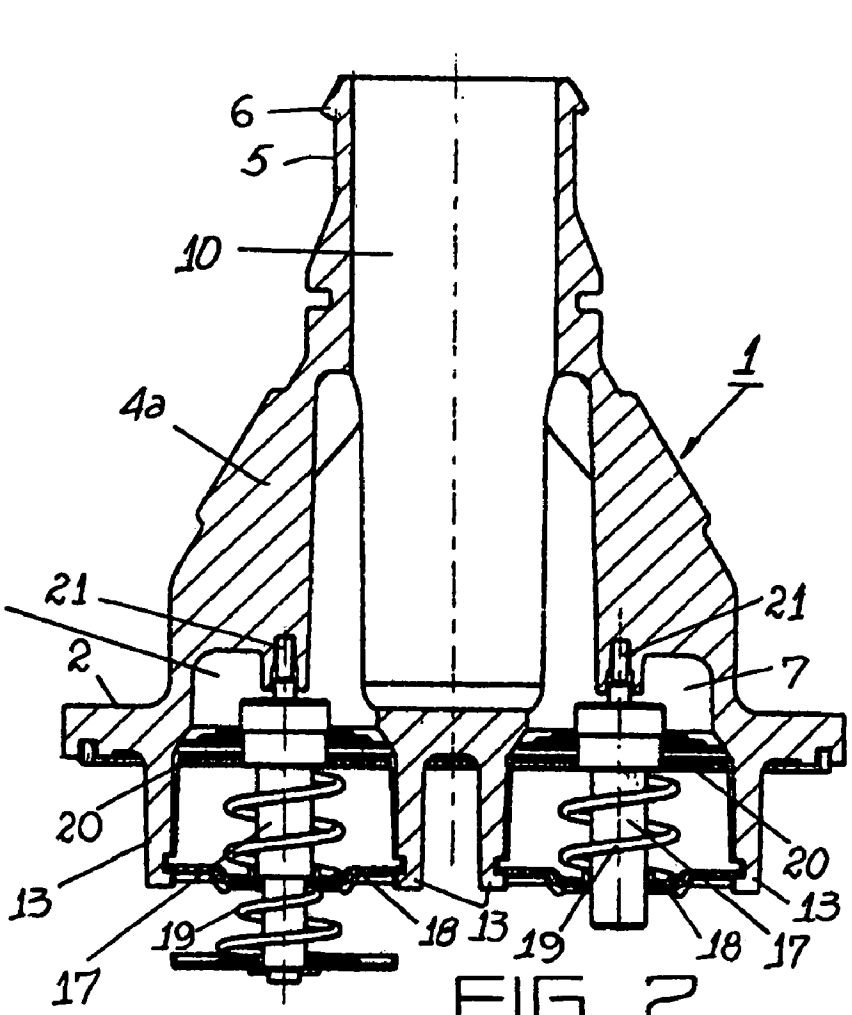
FIG. 2 represents an elevation and sectional view of the type of cover or housing showed in the FIG. 1, with two integrated thermostats.
Figure 1:
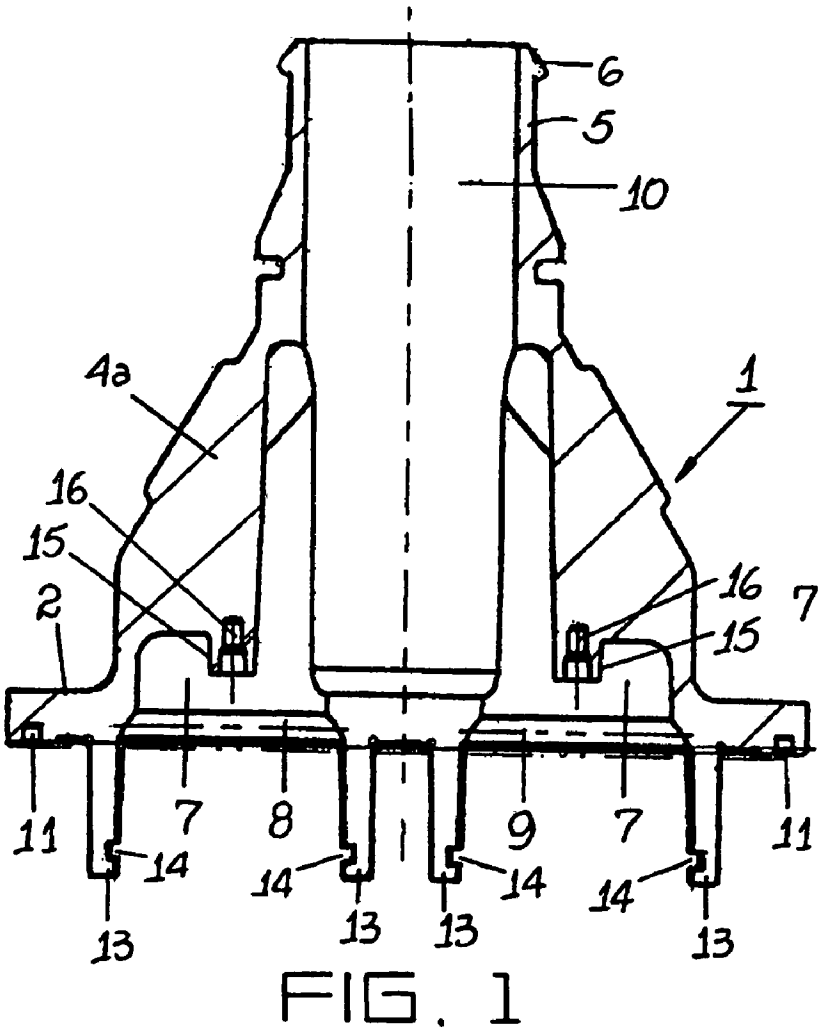
FIG. 1 represents an elevation and sectional view of a type of cover or housing for integrating a double thermostat obtained by the process that is the object of the present invention (in this figure, thermostats are absent).
Figure 3:
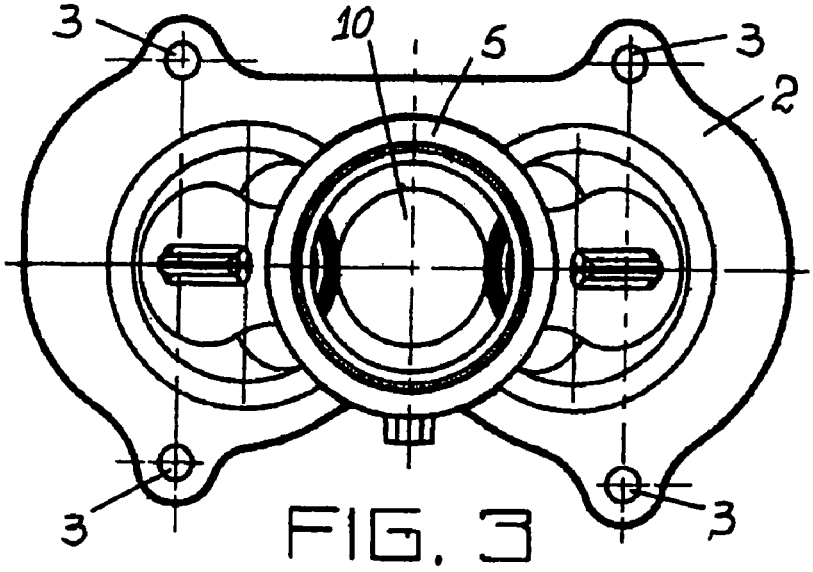
FIG. 3 represents a top view of the type of cover or housing showed in FIGS. 1 and 2.
Figure 4:
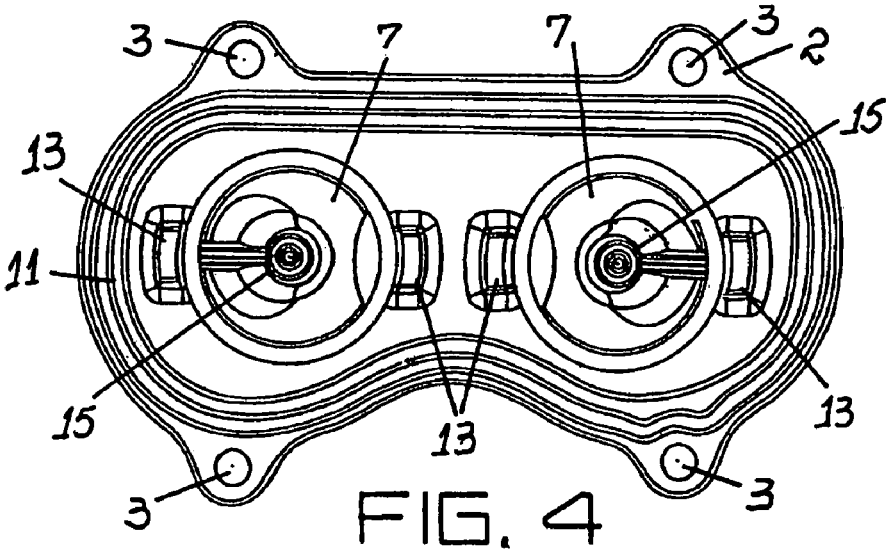
FIG. 4 represents a bottom view of the type of cover or housing represented in FIG. 1 (without thermostats).
Figure 5:
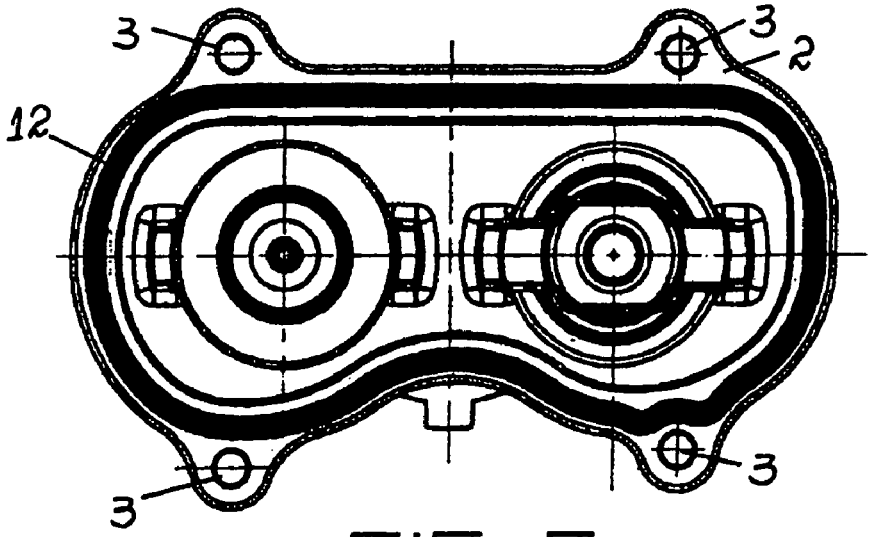
FIG. 5 represents a bottom view of the type of cover or housing represented in FIG. 2 (with two integrated thermostats).
Figure 6:
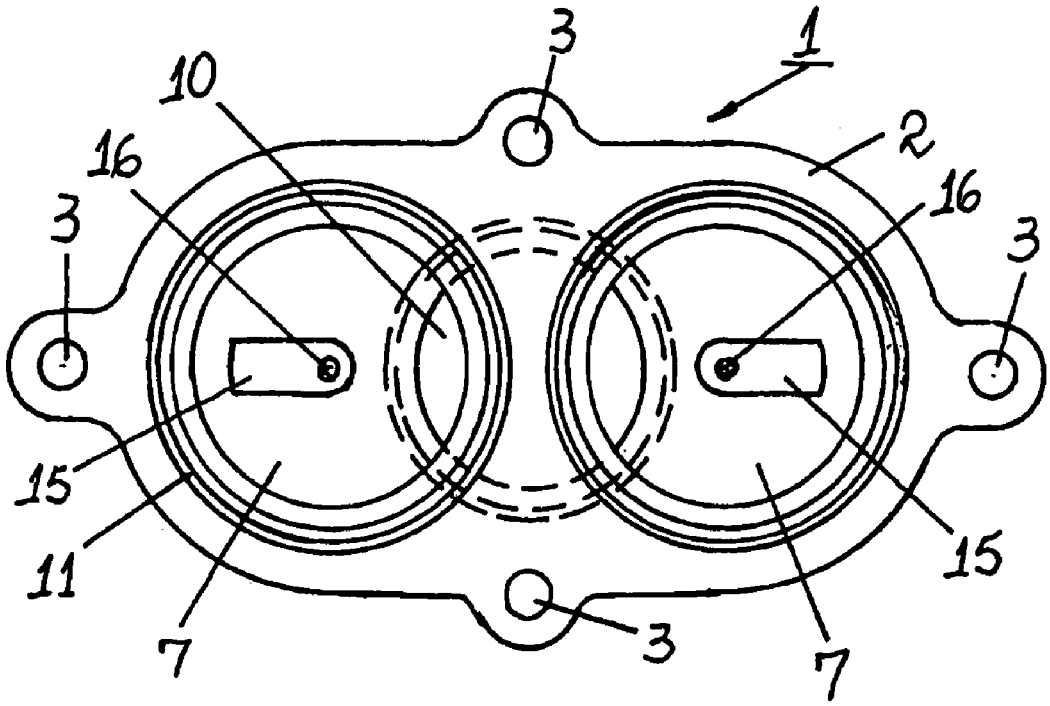
FIG. 6 represents a bottom view of a second type of cover or housing of integration of double thermostat obtained by the process that is the object of the present invention (without thermostats).

It is necessary to clarify that thermostat valves themselves are known, and any thermostat valves can be used with the present invention, and they are cited herein as an example of use and assembly.

The thermostat is composed of a working element or a temperature sensor (17), an arch to support the entire set (18) and a helical spring (19) that is located between the supporting arch and an upper peripheral border (20) linked to the working element or temperature sensor, which defines the obstruction element, controlling the cooling liquid passage, which can be rubberized, though other materials are possible. In the upper extremity of the working element or temperature sensor there is a projected central pin (21).

The thermostat is integrated to the cover or to the housing (1) by inserting ends of the supporting arch in a pair of downwardly projecting legs (13) of the cover and by lodging the central pin (21) in a hole (16) located internally to the body of the cover.

In accordance with the accompanying illustrative drawings and their details, the cover or the housing used to integrate simultaneously the two thermostat valves comprises a part that can be made of aluminum, polymeric, metallic or nonmetallic material and obtained by molding, injection or machining process, which presents a hollowed body (1) projected from a flange (2) provided with appropriated holes (3) for receiving fixing screws for fixing the cover/thermostats set to the engine.

Figure 7:
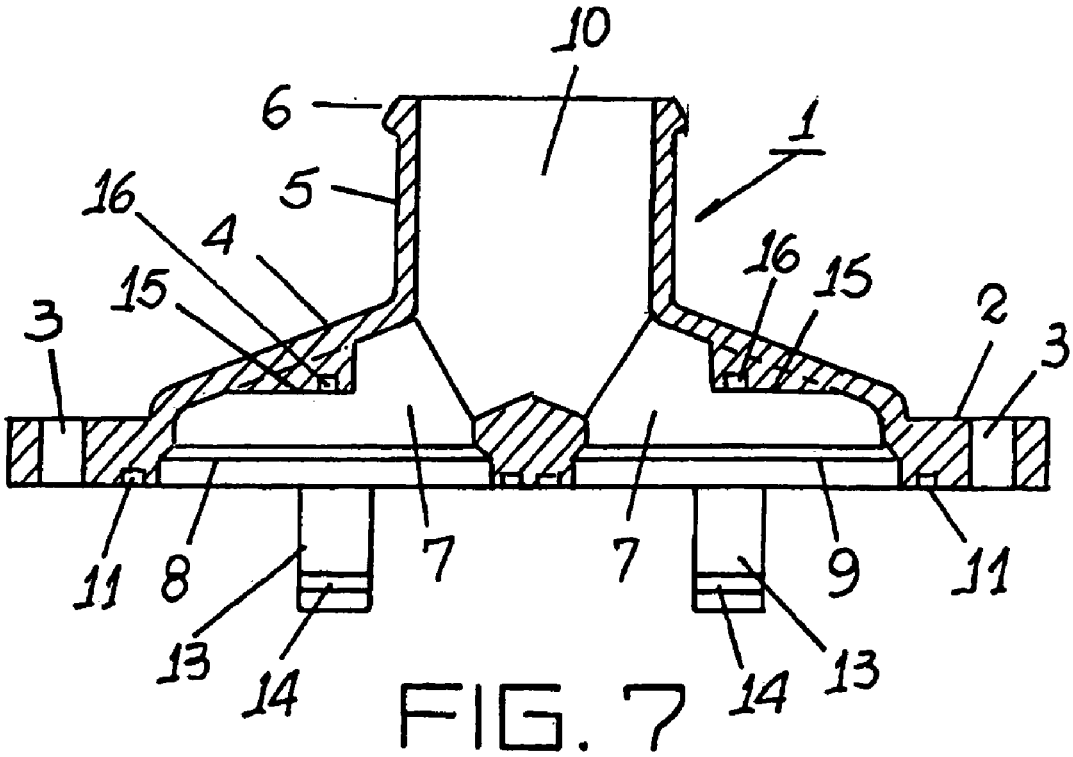
FIG. 7 represents elevation and sectional view of the type of cover or housing showed in FIG. 6.

The hollowed body (1) has a surface with a slight inclination (4) (see FIG. 7) or a significant inclination (4*a*) that is convergent to a center of the part, and in which a vertical tubular element (5) is located for interconnection with the radiator via a flow hose for the cooling liquid. This element (5) has a salient conical ring (6) at its forward end to guarantee a good coupling with the related hose.

In the interior of the hollowed body (1), there are defined two adjacent galleries (7) with independent end entrances (8 and 9) that are open in the base of the flange (2) and a single exit (10) defined by the tubular element (5) on the top of the part. The mouthpieces of the two independent entrances are surrounded by grooves (11) that are designed to house sealing rings (12).

In two diametrically opposing sides of each independent entrance (8 and 9) of adjacent galleries (7), two legs (13) are orthogonally projected, and the legs are provided with a transversal groove (14) near to their lower ends and in the confronting faces, where the thermostats are incorporated by inserting the ends of the supporting arch in the legs, as seen in FIG. 2.

At the back of the galleries (7) and in alignment with the center of each independent entrance (8 and 9), there is a protuberance (15) provided with a non-threaded hole (16) to centralize the assembly of thermostats, by inserting the central pin (21), which will be lodged therein.

One of the main characteristics of the present invention consists in obtaining two adjacent galleries with independent entrances and a single reciprocal central exit, which is a solution impracticable for conventional processes, as it never existed until now.

The proposed solution is based on an aluminum injection process or a polymer injection process, where is foreseen the introduction of a double male core for forming the lower section of the cover or housing for forming two adjacent galleries (7) with independent openings (8) and (9), as well as the entrance of a male core by the upper section for defining the single reciprocal central exit that is in intercommunication with the two adjacent galleries (7).

Therefore, the invention is of great importance to the proposed object that consists of obtaining an integrated set provided with two adjacent galleries having independent entrances and a single reciprocal central exit, which allows the integration of two thermostat valves in a single housing, providing a series of technical, practical, functional and economic advantages, encompassing proper and innovative characteristics.

While preferred embodiments of the present invention have been shown and described, it will be understood by those skilled in the art that various modifications can be made without varying from the spirit and scope of the invention.

What is claimed is:

1. A cover or housing for housing two thermostat valves as a single compact set for mounting on an engine comprising:

a hollowed body projecting from a flange having holes for fixing the cover to an engine, the hollowed body having a surface inclined to a center part thereof containing a vertical tubular element for interconnecting to a radiator, the hollowed body having two adjacent galleries, each gallery having an independent entrance in a base of the flange, and each gallery having an exit leading into the tubular element, providing a single common exit from the cover or housing, each gallery having downwardly projecting legs having grooves at their ends disposed in a facing relationship for receiving the ends of a thermostat therein, for mounting the thermostat in the gallery, an upper end of each gallery containing a centering hole for receiving a center point of a thermostat therein.

2. The cover or housing of claim 1 wherein the cover or housing is made of a material selected from the group consisting of metallic, nonmetallic and polymer materials.

3. The cover of claim 1 wherein the cover or housing is made of aluminum.

4. The cover or housing of claim 1 wherein the flange has mouthpieces around the entrances to the galleries, a peripheral groove surrounding the mouthpieces for receiving sealing means therein.

5. The cover or housing of claim 1 further comprising two thermostats mounted therein, each thermostat having supporting arches and central pins received in the corresponding leg grooves and openings in the two galleries.

6. The cover or housing of claim 1 wherein the tubular element has a conical projecting ring located about an upper end thereof for engaging a hose placed thereover.

7. The cover or housing of claim 1 wherein each gallery has two downwardly projecting diametrically opposing sides forming each independent entrance (8 and 9) of adjacent galleries (7), two orthogonal legs (13) provided with a transversal groove (14) near to their extremities and in the confronting faces for receiving ends of a supporting arch of each thermostat, each gallery (7) in coaxial alignment with the center of each independent entrance (8 and 9), and with the hole for receiving the central pin of each thermostat received therein.

8. The cover or housing of claim 1 produced by a process selected from the group consisting of molding, injection molding, machining or a combination thereof.

9. The cover or housing of claim 1 produced by a process comprising placing a double male core in a mold corresponding in shape to the two galleries, placing a single male core in the mold corresponding to the tubular element, the cores defining the hollowed portions of the cover or housing, injecting a material into the mold which surrounds the cores, and then removing the cores to form the cover or housing.

* * * * *